US010505288B2

(12) United States Patent
Naganuma

(10) Patent No.: US 10,505,288 B2
(45) Date of Patent: Dec. 10, 2019

(54) ELECTRICAL CONNECTOR HAVING TERMINAL SUPPORTS

(71) Applicant: HIROSE ELECTRIC CO., LTD., Tokyo (JP)

(72) Inventor: Kenichi Naganuma, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/317,442

(22) PCT Filed: Jul. 11, 2017

(86) PCT No.: PCT/JP2017/025284
§ 371 (c)(1),
(2) Date: Jan. 11, 2019

(87) PCT Pub. No.: WO2018/016388
PCT Pub. Date: Jan. 25, 2018

(65) Prior Publication Data

US 2019/0229438 A1 Jul. 25, 2019

(30) Foreign Application Priority Data

Jul. 20, 2016 (JP) ..... 2016-142463

(51) Int. Cl.
*H01R 4/24* (2018.01)
*H01R 13/514* (2006.01)
(Continued)

(52) U.S. Cl.
CPC ..... *H01R 4/24* (2013.01); *H01R 13/502* (2013.01); *H01R 13/514* (2013.01);
(Continued)

(58) Field of Classification Search
CPC .... H01R 4/24; H01R 13/502; H01R 13/6585; H01R 13/514; H01R 24/60; H01R 24/62; H01R 4/2433
(Continued)

(56) References Cited

U.S. PATENT DOCUMENTS 5,273,459 A 12/1993 Davis
5,376,018 A 12/1994 Davis et al.
(Continued)

FOREIGN PATENT DOCUMENTS

JP H111297403 A 10/1999
JP H111512558 A 10/1999
(Continued)

OTHER PUBLICATIONS

International Search Report dated Oct. 3, 2017 filed in PCT/JP2017/025284.

*Primary Examiner* — Jean F Duverne
(74) *Attorney, Agent, or Firm* — Rankin, Hill & Clark LLP

(57) ABSTRACT

An electrical connector in a type of connectors that comes into contact with a counterpart connector in a gap between contacts of terminals is provided in which the adjustment of contact positions of the terminals is easy and therefore the manufacture of the electrical connector is easy and the manufacturing cost is low. The electrical connector includes a housing and paired terminal supports. Each of the paired terminal supports can support the terminals in cantilever fashion. Moreover, the paired terminal supports are mounted on the housing in a state of abutting each other in predetermined directions. The terminals supported by the terminals supports mounted on the housing can form a gap where a
(Continued)

contacted object is inserted, between the contacts of the terminals in a direction along the abutment directions of the paired terminal supports.

8 Claims, 12 Drawing Sheets

(51) Int. Cl.
*H01R 24/60* (2011.01)
*H01R 13/502* (2006.01)
*H01R 13/6585* (2011.01)
*H01R 107/00* (2006.01)

(52) U.S. Cl.
CPC ..... *H01R 13/6585* (2013.01); *H01R 24/60* (2013.01); *H01R 2107/00* (2013.01)

(58) Field of Classification Search
USPC ..... 439/387
See application file for complete search history.

(56) References Cited

U.S. PATENT DOCUMENTS

| | | | | |
|---|---|---|---|---|
| 5,376,108 | A | 12/1994 | Collins | |
| 6,176,745 | B1 | 1/2001 | Furutani | |
| 6,454,605 | B1 | 9/2002 | Bassler | |
| 8,650,750 | B2 * | 2/2014 | Engels | H01R 4/2433 29/857 |
| 9,419,391 | B2 * | 8/2016 | Bolouri-Saransar | H01R 4/24 |
| 9,484,671 | B2 * | 11/2016 | Zhu | H01R 24/62 |
| 2013/0203282 | A1 | 8/2013 | Engels | |

FOREIGN PATENT DOCUMENTS

| | | | |
|---|---|---|---|
| JP | 3362930 | B2 | 1/2003 |
| JP | 2003529908 | A | 10/2003 |
| JP | 2005149935 | A | 6/2005 |
| JP | 2005327701 | A | 11/2005 |
| JP | 3160343 | U | 6/2010 |
| WO | 9710628 | A1 | 3/1997 |

* cited by examiner

ELECTRICAL CONNECTOR HAVING TERMINAL SUPPORTS

TECHNICAL FIELD

The present invention relates to an electrical connector having terminal supports.

BACKGROUND ART

A terminal support may be used as a separate body from a main body of a housing to hold a terminal of an electrical connector. For example, Patent Document 1 illustrates an example of an electrical connector having a contact support block that can hold a plurality of terminals. It is configured in such a manner that the plurality of terminals is placed on both the upper and lower sides of the contact support block. The pluralities of terminals placed on the contact support block are placed in the connector in a state where a plate-shaped body is sandwiched in a gap formed between the terminals in the up-and-down direction. It is configured in such a manner that the contact with a counterpart connector is made on sides opposite to the gap sides between the terminals, in other words, on an upper exposed surface of the terminals placed on the upper side and on a lower exposed surface of the terminals placed on the lower side.

CITATION LIST

Patent Literature

Patent Document 1: Japanese Patent No. 3362930

DISCLOSURE OF THE INVENTION

Problems to be Solved by the Invention

It is necessary for a terminal support of the type disclosed in Patent Document 1 to arrange a plurality of terminals on both upper and lower sides of the terminal support. As a result, it is necessary to arrange terminals on each side in a thickness direction of the terminal support without changing the orientation of the terminal support, or arrange terminals on one side in the thickness direction of the terminal support and then turn the terminal support, or a device for mounting terminals, upside down, and arrange terminals on the other side; therefore, the work is complicated. Moreover, in the terminal arrangement method disclosed in Patent Document 1, it is necessary for a connector of a type where the contact with a counterpart connector is made in a gap between contacts of terminals, unlike the connector of the type disclosed in Patent Document 1, to, for example, adjust the contact positions of the terminals, and there is a problem that increases in manufacturing time and manufacturing cost are incurred.

The invention of the present application has been made to solve such problems in the known technology, and especially an object thereof is to provide an electrical connector, in a type of connectors that comes into contact with a counterpart connector in a gap between contacts of terminals, in which the adjustment of contact positions of the terminals is easy and therefore the manufacture of the electrical connector is easy and the manufacturing cost is low.

Solutions to the Problems

In order to solve the above problems, an electrical connector according to an aspect of the present invention includes: a housing; and paired terminal supports, each of the paired terminal supports is capable of supporting terminals in cantilever fashion, and upon being mounted on the housing in a state of abutting each other, the paired terminal supports are capable of forming a gap where a contacted object is inserted, between contacts of the terminals supported by the terminal supports in a direction along abutment directions of the paired terminal supports.

According to the electrical connector of the aspect, an appropriate gap where a terminal contacted object is inserted can be formed between the contacts of the terminals by simply causing the paired terminal supports that support the terminals to abut in predetermined directions and mounting them on the housing as they are. Accordingly, the manufacture of the electrical connector is facilitated, and the manufacturing cost is also reduced.

In the electrical connector of the aspect, it is preferable that in a state where substantially flat surfaces of the paired terminal supports abut each other, the terminal supports be mounted on the housing parallel to the substantially flat surfaces. According to the electrical connector of the aspect, it is configured in such a manner that the substantially flat surfaces abut each other and the mounting on the housing is performed parallel to the flat surfaces; accordingly, it is possible to make it suitable for mechanical production.

In the electrical connector of the aspect, it is preferable that the terminal support be provided with a means for preventing displacement in a direction parallel to the substantially flat surfaces. According to the electrical connector of the aspect, the displacement prevention means is provided; accordingly, the terminal supports can be mounted on the housing in a more stable state.

Moreover, in the electrical connector of the aspect, it is preferable that the electrical connector further include cable holders that are capable of mounting one end side of a cable thereon, and the cable holders be capable of being mounted on the terminal support along the abutment directions on sides of the paired terminal supports opposite to the abutment sides in the direction along the abutment directions.

According to the electrical connector of the aspect, the abutment directions of the paired terminal supports are made the same as the mounting directions of the cable holders on these terminal supports; accordingly, the manufacturing cost can be reduced with a configuration more suitable for mechanical production.

Furthermore, in the electrical connector of the aspect, it is preferable that the terminals include cable insulation-displacement portions vertically arranged in directions opposite to the abutment directions on the sides of the paired terminal supports opposite to the abutment sides in the direction along the abutment directions.

According to the electrical connector of the aspect, the cable insulation-displacement portion is provided along the mounting direction of the cable holder; accordingly, the cable can be installed to the terminal, using a force at the time of mounting the cable holder.

Moreover, in the electrical connector of the aspect, it is preferable that the terminal supports include fixing portions that fix at least part of the terminal on the sides of the paired terminal supports opposite to the abutment sides in the direction along the abutment directions, and at least other part of the terminal within a surface on the opposite side, the other part being located between the fixing portion and the cable insulation-displacement portion, be covered by an extending portion extending from the vertically arranged portion to the cable insulation-displacement portion side within the surface on the opposite side in a direction along a lead-out direction of the cable from the cable holder.

According to the electrical connector of the aspect, the extending portion is provided; accordingly, it is possible to prevent a fault where, for example, a core in the cable exposed by the cable insulation-displacement portion is shortened to an adjacent terminal.

Moreover, in the electrical connector of the aspect, it is preferable that the paired terminal supports have substantially the same size and shape.

According to the electrical connector of the aspect, the terminal supports are made substantially the same size and shape; accordingly, the management of components is facilitated, and the manufacturing process is also simplified.

Effects of the Invention

An electrical connector in a type of connectors that comes into contact with a counterpart connector in a gap between contacts of terminals is provided in which the adjustment of contact positions of the terminals is easy and therefore the manufacture of the electrical connector is easy and the manufacturing cost is also low.

BEST MODE FOR CARRYING OUT THE INVENTION

An electrical connector according to a preferred embodiment of the present invention is described hereinafter with reference to the accompanying drawings. Only the preferred embodiment of the present invention is illustrated here. However, naturally, this is not intended to limit the present invention.

Figure 1:
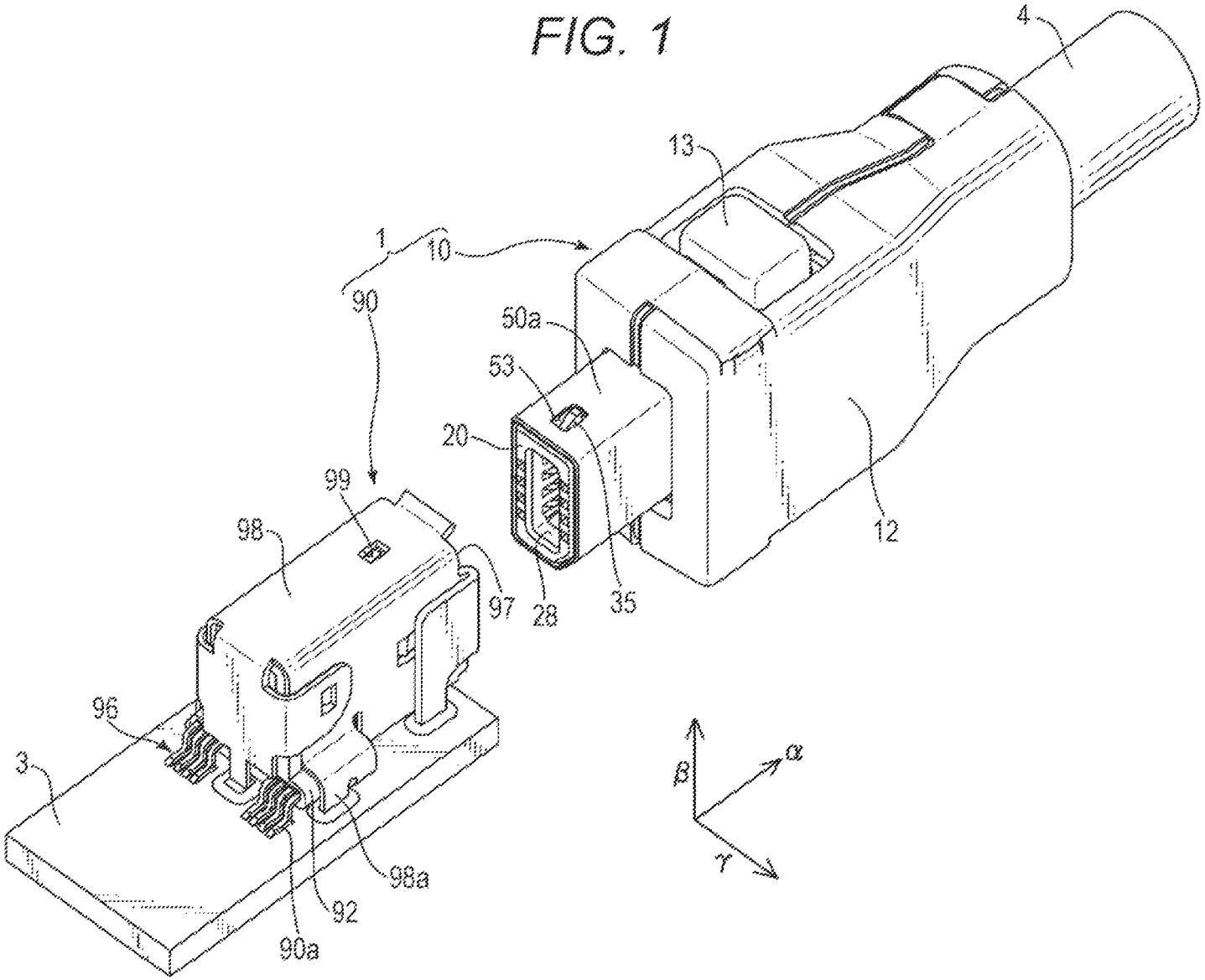
FIG. 1 is a perspective view of an electrical connector device using an electrical connector according to the present invention.

FIG. 1 is a perspective view of an electrical connector device 1 using an electrical connector 10 according to the present invention. The electrical connector device 1 includes a pair of the electrical connector 10 and a counterpart connector 90. The electrical connector 10 may be, for example, a connector of a cable type that is connected to an electrical cable 4. The counterpart connector 90 may be, for example, a connector of a board type that is connected to a board 3. Naturally, the connectors are not limited to them. As long as the present invention can be employed, for example, the electrical connector 10 may be of the board type, and the counterpart connector 90 may be of the cable type. Moreover, both of the connector 10 and the counterpart connector 90 may be of the board type, or both of them may be of the cable type.

The electrical connector 10 can be mated with and removed from the board connector 90 along an illustrated arrow "α" direction. In the description, for the sake of convenience, a description is given, letting a direction along the mating and removable directions of the electrical connector 10 and the board connector 90 be the "α" direction, letting a height direction with respect to the board 3 of the board connector 90 be a "β" direction, and letting a width direction of the board connector 90 be "γ".

The mating of the electrical connector 10 and the board connector 90 can be locked using their shells. When the electrical connector 10 and the board connector 90 are mated, a tapered mated portion 50*a* provided on the shell of the electrical connector 10 is inserted into a substantially rectangular mating hole 97 provided on a front surface of the board connector 90, and lock portions protruding elastically from an upper side and a lower side of the distal end portion 50*a* of the electrical connector 10, for example, lock protruding portions 35 protruding elastically from holes 53 of the shell, are fitted into locked portions, for example, the through-holes 99, provided on a ceiling portion and a base plate portion of a shell 98 of the board connector 90. As a result, the mating of the electrical connector 10 and the board connector 90 is locked. In terms of the locking, the lock protruding portions 35 can be pulled out of the through-holes 99, by using, for example, a button 13 provided on the electrical connector 10, or more specifically, by pushing the button 13 exposed from a hood 12 into the electrical connector 10 along the "β" direction.

The board connector 90 mainly includes an insulating housing 92, terminals 96 that are held by the insulating housing 92 in a state of being partially exposed from the insulating housing 92, and the conductive shell 98 that covers an outer peripheral surface of the insulating housing 92.

The mating hole 97 that allows a part of the connector 10 to be mated is provided on a front surface of the insulating housing 92. Furthermore, a mating protrusion (not illustrated) that fits a mating recess 28 formed in a housing 20 of the connector 10 is provided in the mating hole 97. The terminals 96 are arranged on the mating protrusion in a state of being exposed on one end side. On the other hand, the other end side 90*a* of the terminals 96 is soldered onto the board 3. A part 98*a* of the shell 98 is fixed at a predetermined position of the board 3. Consequently, the shell 98 is connected to ground.

Figure 2:
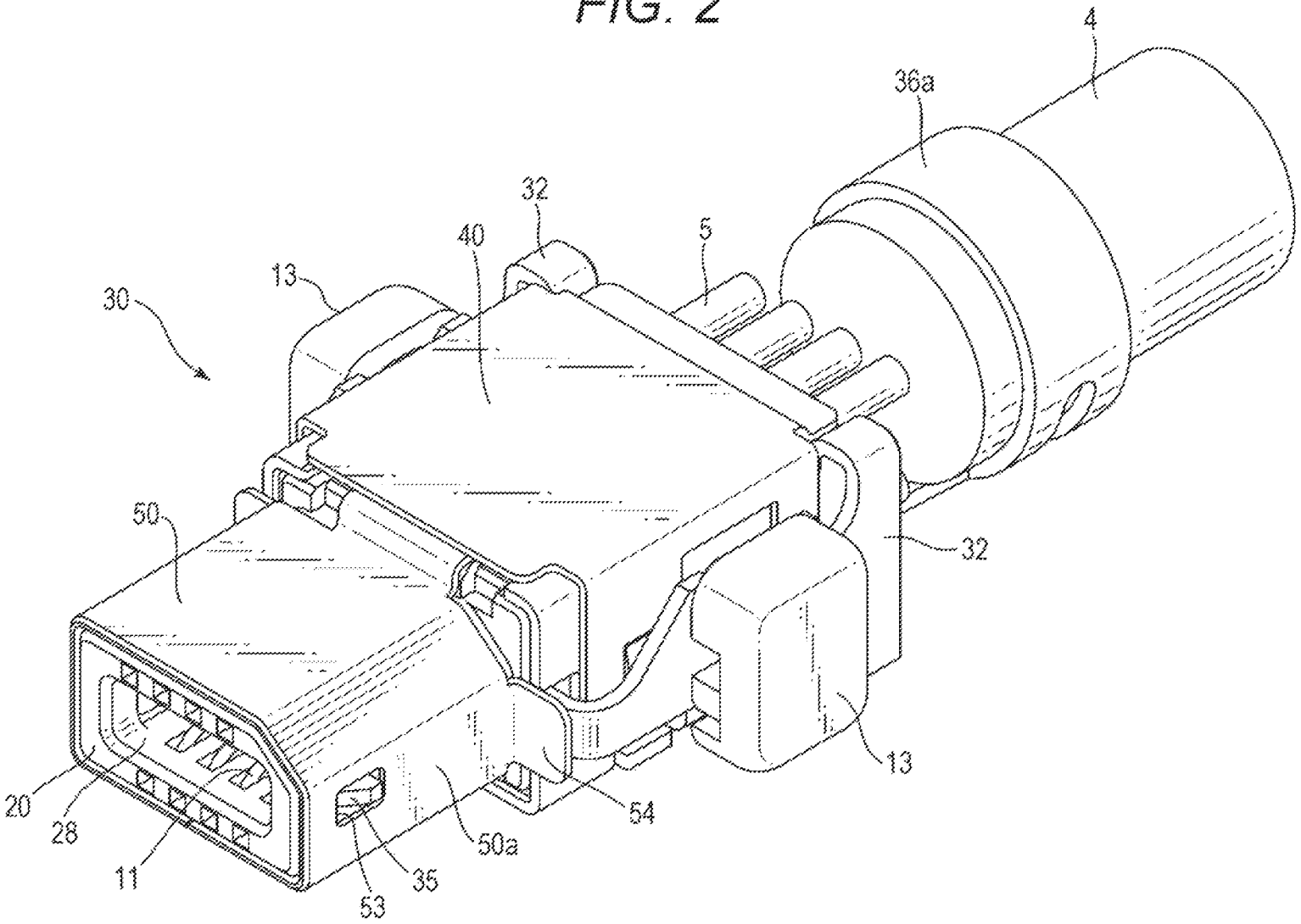
FIG. 2 is a perspective view illustrating an internal structure of the electrical connector.
Figure 3:
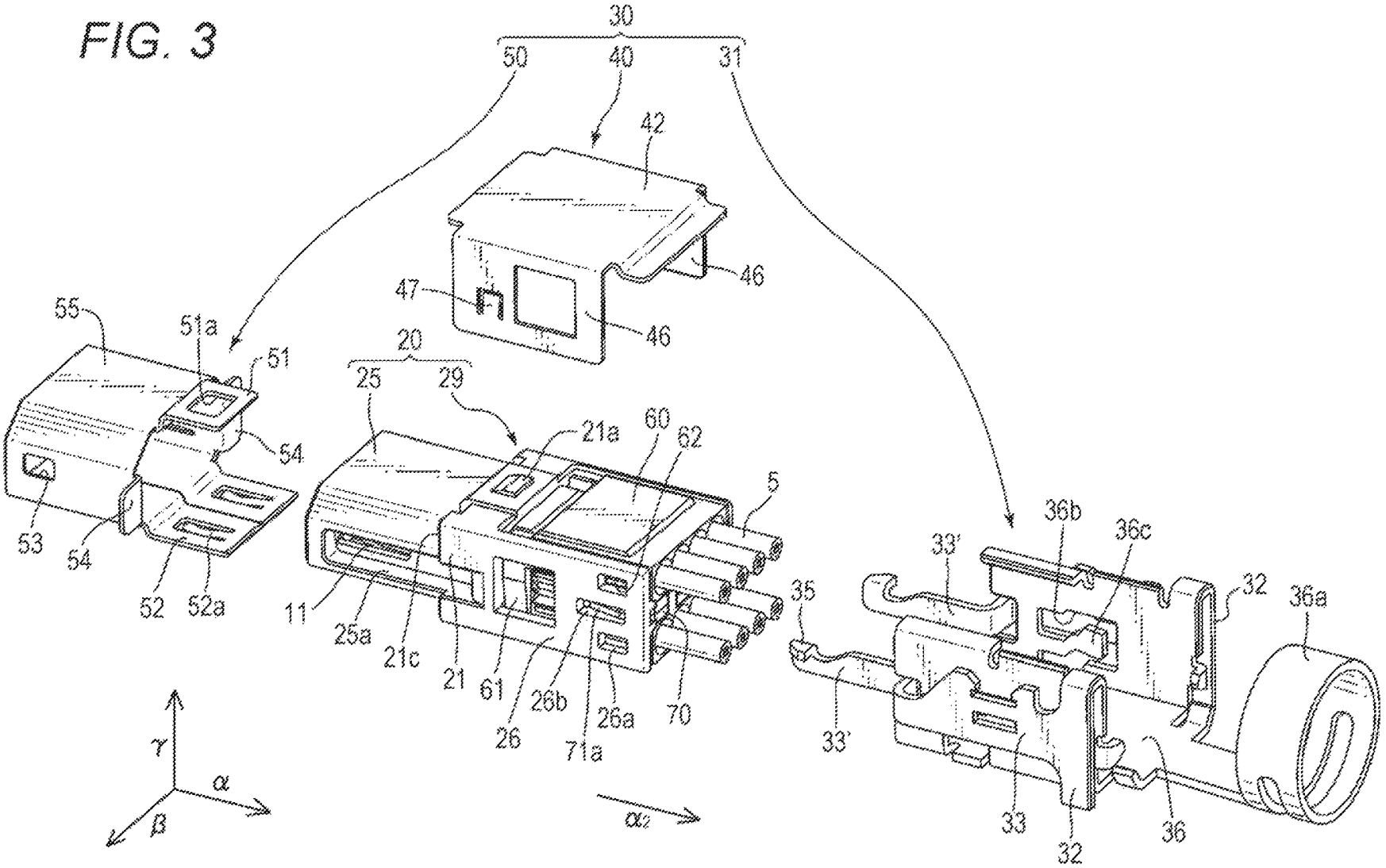
FIG. 3 is an exploded perspective view of the internal structure of FIG. 2.

FIG. 2 is a perspective view illustrating an internal structure of the electrical connector 10. FIG. 3 is an exploded perspective view of the internal structure of FIG. 2. However, FIG. 2 is an illustration where the hood 12 and part of a sheath of the electrical cable 4, which are illustrated in FIG. 1, have been removed. FIG. 3 is an illustration where the sheath of the electrical cable 4 has been completely removed. The electrical cable 4 is assumed to include a plurality of twist pair cables 5 as an example. However, naturally, the present application is not limited to the twist pair cables 5. The electrical connector 10 mainly includes the housing 20 formed of an insulating member such as resin, terminal supports 70 that support terminals 11, cable holders 60 that hold the cables 5, a conductive shell 30 that covers an outer peripheral surface of, for example, the housing 20, and the insulating hood 12 (refer to FIG. 1) that covers an outer peripheral surface of the shell 30.

The housing 20 includes a housing body 29 that is formed in a substantially cuboid shape by being complemented by the terminal supports 70 and the cable holders 60, and an inserted portion 25 protruding from the housing body 29 toward the mating side with the board connector 90 (refer to FIG. 1). The inserted portion 25 is a portion that is inserted into the mating hole 97 (refer to FIG. 1) of the board connector 90. The mating recess 28 into which the mating protrusion (not illustrated) provided in the mating hole 97 of the board connector 90 is inserted is formed in the inserted portion 25.

The shell 30 includes a main body shell 31, a plate-shaped shell 40, and a tubular shell 50. The plate-shaped shell 40 and the main body shell 31 mainly cover outer peripheral surfaces of side portions of, for example, the housing body 29. The plate-shaped shell 40 mainly covers outer peripheral surfaces of side portions of, for example, the housing body 29 that is not covered by the main body shell 31. The tubular shell 50 mainly covers outer peripheral surfaces of side portions of the inserted portion 25 with a slightly small diameter protruding from the housing body 29.

The main body shell 31 is formed by blanking one metal sheet and bending the blank, and has a substantially angular U-shape in cross section as a whole, and mainly includes a base 36, an elastic piece 33 extending frontward of the base 36, and a swaging portion 36*a* of the electrical cable 4 extending rearward of the base 36. A mounting piece 36*c* used to fix the cable 4 is provided in a rear part of the base 36. The base 36 and the elastic piece 33 are elastically connected at a rear end portion of the base 36 via a support portion 32 formed as a folded-over portion of a substantially U-shape in cross section. The elastic piece 33 has a free end on the mating side with the board connector 90. Furthermore, the lock protruding portion 35 used to lock to the board connector 90 is provided at the free end.

The plate-shaped shell 40 is formed by blanking one metal sheet and bending the blank as in the main body shell 31, and has a substantially angular U-shape in cross section as a whole, and includes a base 42 and two opposing plate portions 46. The plate-shaped shell 40 is mounted in such a manner as to sandwich the main body shell 31 between the two opposing plate portions 46. When the main body shell 31 is mounted, a tongue-shaped mounting piece 47 provided to the plate portion 46 is locked to an edge 36*b* of a mounting hole provided in the main body shell 31 and fixed to the edge 36*b*.

The tubular shell 50 is also formed by blanking one metal sheet and bending the blank as in the main body shell 31 and the plate-shaped shell 40, and has a substantially rectangular tubular shape as a whole, and includes a tubular base 55, mounting pieces 51 and 52 extending rearward from the base 55, and a pair of standing pieces 54 provided vertically outward on an edge of the base 55. The tubular shell 50 is mounted in such a manner as to insert the inserted portion 25 of the housing 20 into the tube of the base 55. At this point in time, the pair of standing pieces 54 is positioned with respect to the housing 20 by, for example, abutting a ring-shaped step surface 21*c* formed using a difference in diameter between the inserted portion 25 and the housing main body 29 of the housing 20. A hole 51*a* is provided on the mounting piece 51. When the tubular shell 50 is mounted, a locking protruding portion 21*a* provided to a base 21 of the housing 20 is fitted in the hole 51*a*. Moreover, locking pieces 52*a* are provided to the mounting piece 52. The locking pieces 52*a* are locked at predetermined portions of the main body shell 31.

When the tubular shell 50 is mounted on the inserted portion 25, the lock protruding portion 35 provided at the free end of the elastic piece 33 of the main body shell 31 is brought into a state of elastically protruding from the hole 53 provided on the base 55 of the tubular shell 50. Moreover, at this point in time, a portion 33' on the free end side of the elastic piece 33 is placed in a gap formed between the tubular shell 50 and the inserted portion 25, and is protected by the tubular shell 50. It is preferable to provide an indentation 25*a* that releases the elastic piece 33 on a side surface of the inserted portion 25. Consequently, a portion where the portion 33' on the free end side of the elastic piece 33 is placed can be provided without increasing the size of the device.

Figure 4:
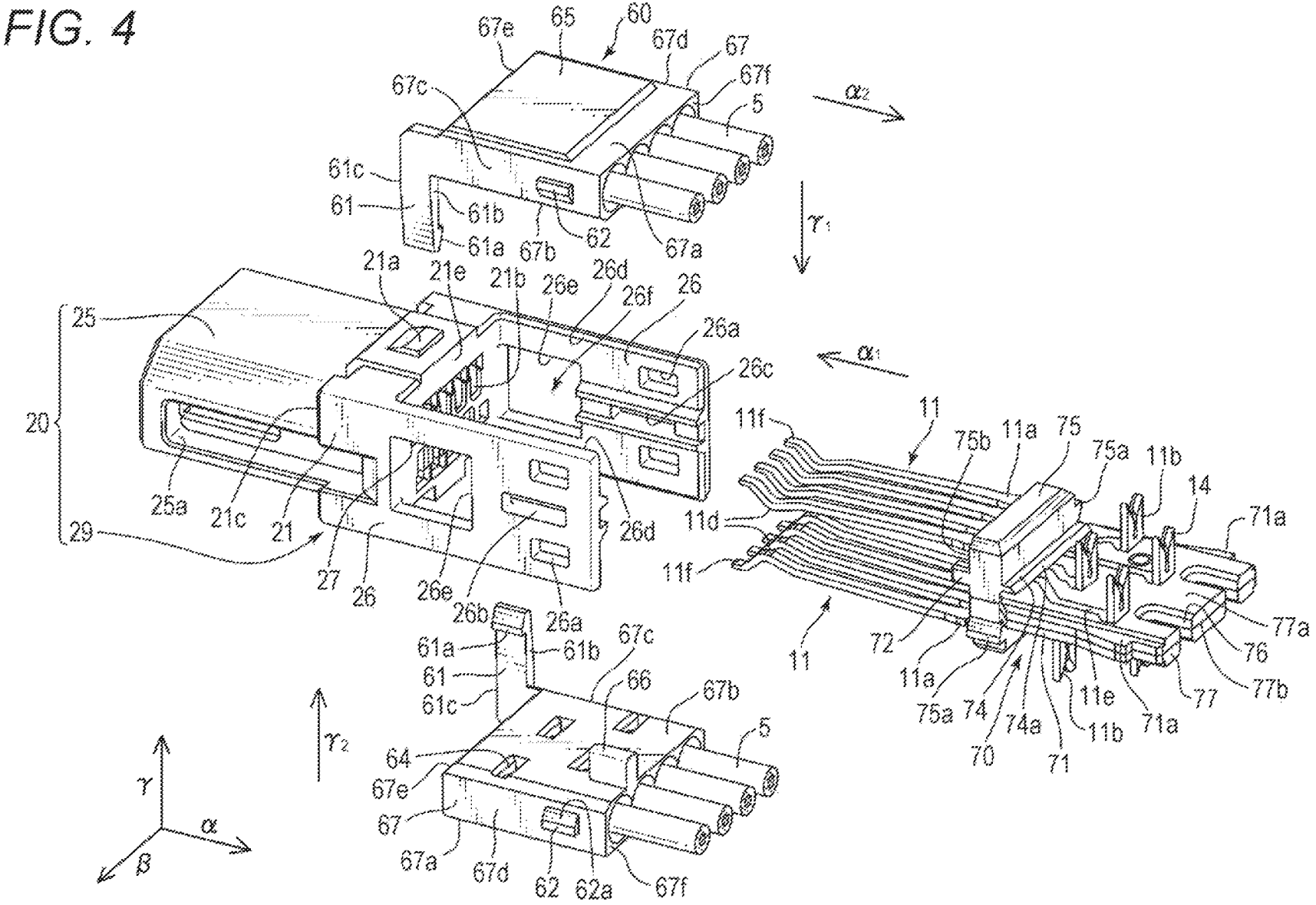
FIG. 4 is an exploded perspective view of, for example, a housing.
Figure 5:
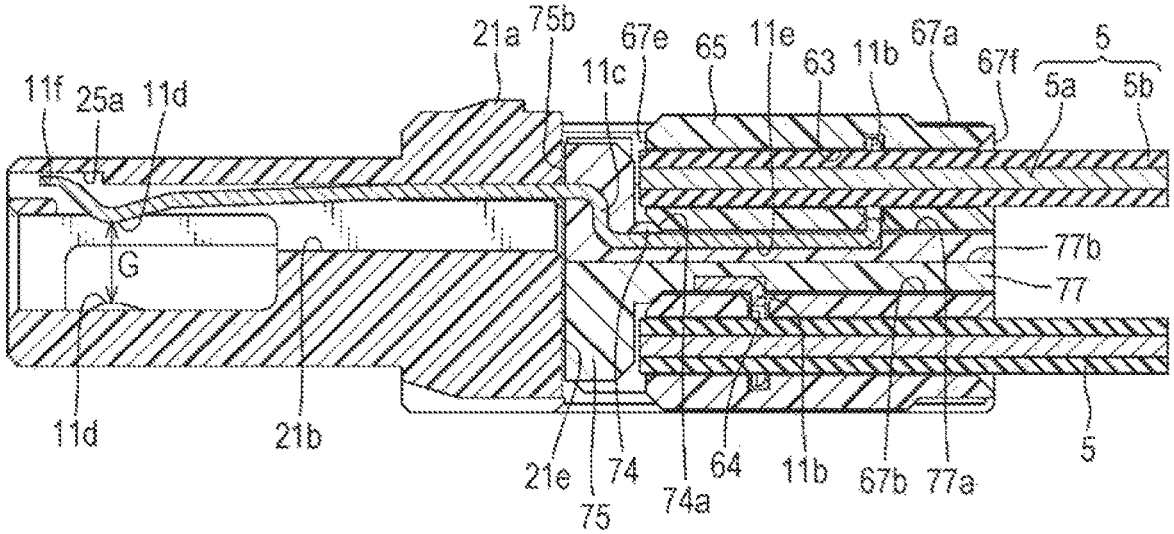
FIG. 5 is a vertical cross-sectional view of, for example, the housing.

FIG. 4 illustrates a perspective view of the housing 20 together with the terminal supports 70 and the cable holders 60, which have been removed from the housing 20. Furthermore, FIG. 5 illustrates a vertical cross-sectional view of the housing 20, and the terminal supports 70 and the cable holders 60, which have been mounted on the housing 20. FIG. 5 corresponds to a cross-sectional view taken along line E-E in FIG. 19 described below and, for the sake of convenience, is assumed to illustrate a state where the twist pair cables 5 have been connected. The housing body 29 includes the thick base 21, and two opposing plate-shaped side walls 26 extending rearward of the base 21, that is, opposite the inserted portion 25. The paired terminal supports 70 and the cable holders 60 paired likewise are placed in a space 26*f* formed between these plate-shaped side walls 26.

It is preferable that both of the paired terminal supports 70 have the same size and shape. Similarly, it is preferable that both of the paired cable holders 60 have the same size and shape. Having the same size and shape makes the management of components easy and also makes the manufacturing process simple. However, it is not necessarily required to have the same size and shape, and different sizes and shapes are also acceptable. Moreover, as long as the above effects can be obtained, having completely the same size and shape is not necessarily required, and having substantially the same size and shape is sufficient.

The terminal support 70 can support a plurality of the terminals 11 in cantilever fashion. The terminals 11 may be integrated by integral molding at the time of manufacture, or may be integrated with the terminal support 70 from the rear or above, using press-fitting or the like. In this example, a description is given assuming integral molding. Part of the terminal 11 is still exposed to the outside after being integrated. For example, a front part of the terminal 11, in other words, the vicinity of a distal end 11*f* of the terminal 11 extending to the base 21 side of the housing 20, and a rear part of the terminal 11, in other words, a cable insulation-displacement portion 11*b* to which the twist pair cable 5 is forced to be connected and a wiring portion 11*e* near the cable insulation-displacement portion 11*b*, are exposed. The distal end 11*f* side of the terminal 11 can be elastically displaced along the direction γ.

The terminal support 70 includes a plate-shaped main body 77. A vertically arranged portion 75 is provided on a top surface 77*a* of the main body 77, a lock projection 71*a* protruding outward is provided on each of the left and right side surfaces of the main body 77, and a notch 76 of a U-shape in plan view cut out inward is provided at a rear edge of the main body 77.

Figure 6:
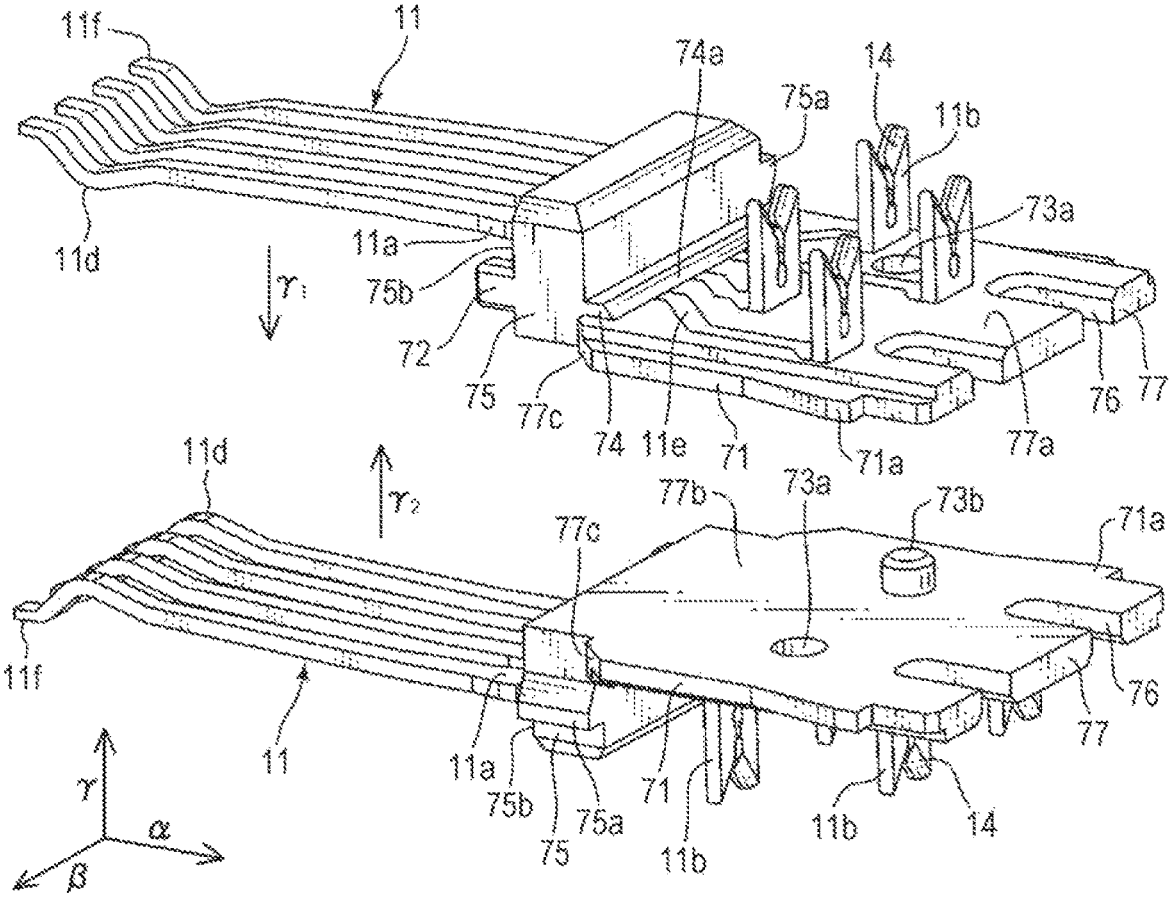
FIG. 6 is a perspective view of terminal supports before abutment.
Figure 7:
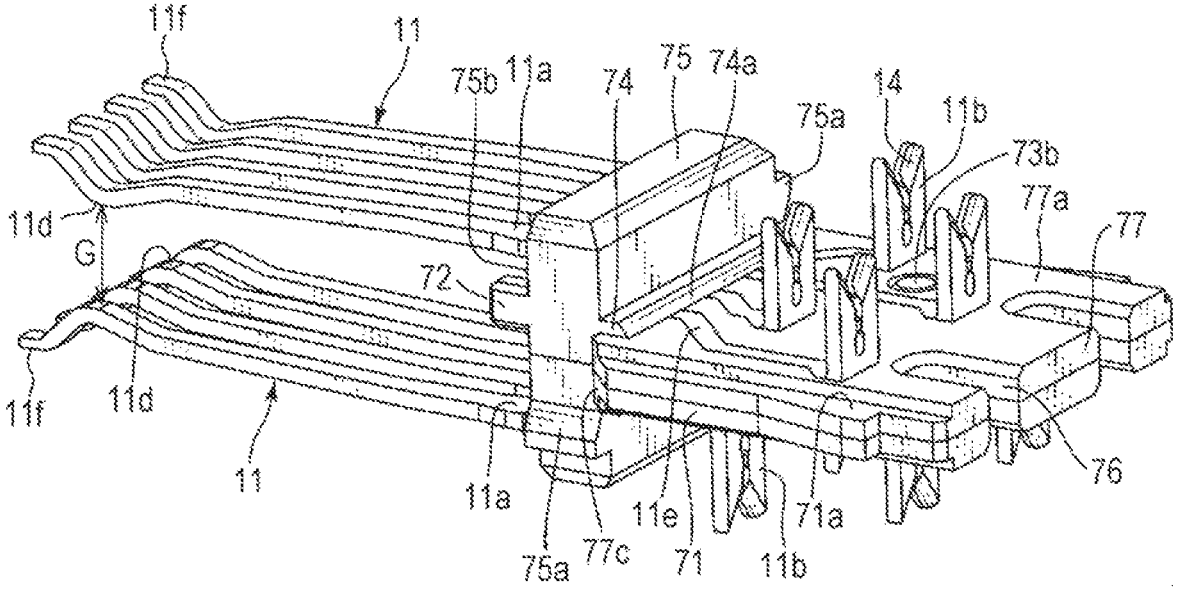
FIG. 7 is a perspective view of the terminal supports after abutment.
Figure 8:
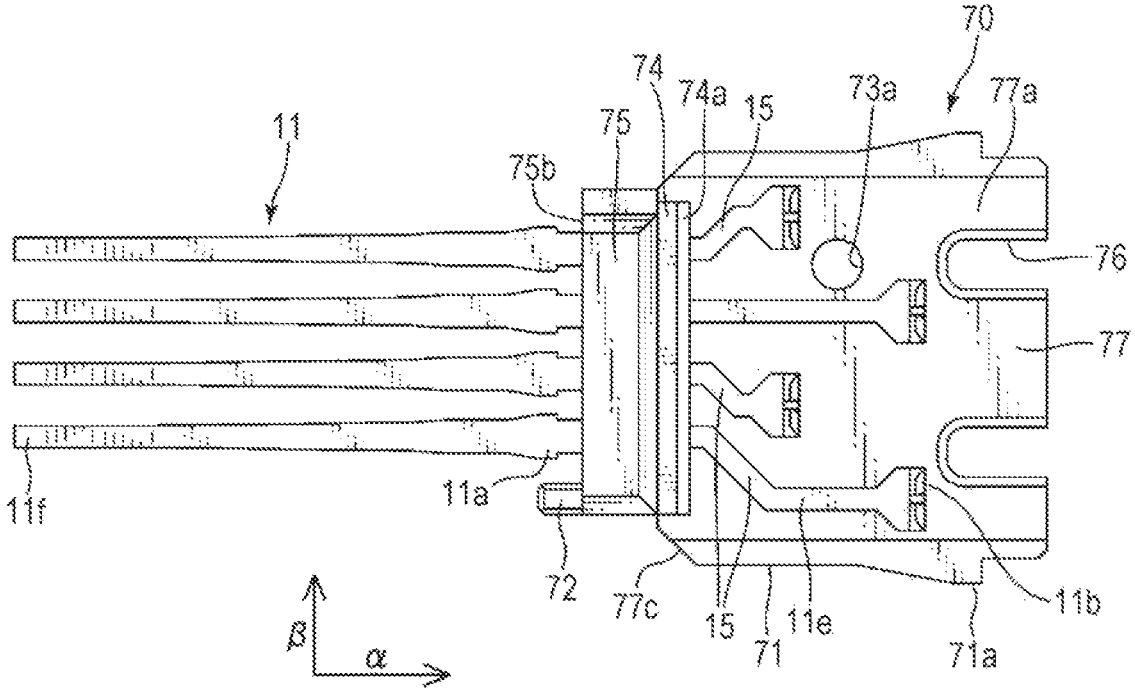
FIG. 8 is a plan view of the terminal support.
Figure 9:
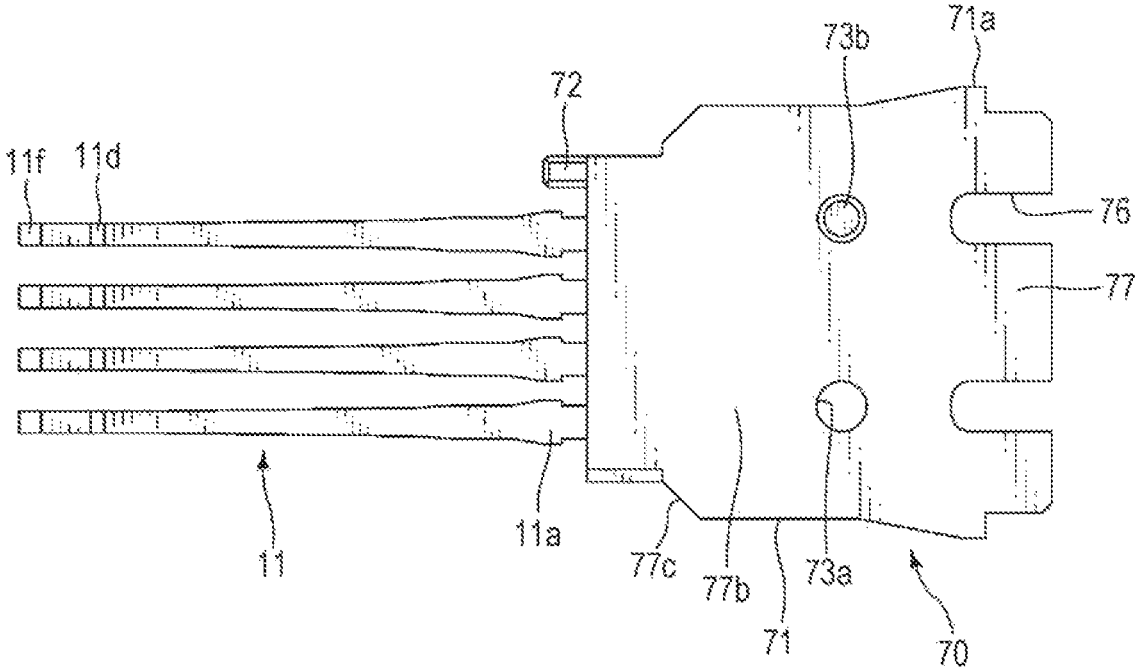
FIG. 9 is a bottom view of the terminal support.

At the time of assembly, firstly, the paired terminal supports 70 are abutted against each other in predetermined directions. FIGS. 6 and 7 illustrate a perspective view of the terminal supports 70 before the abutment and a perspective view of the terminal supports 70 after the abutment, respectively. Furthermore, FIGS. 8 and 9 illustrate a plan view of each terminal support 70 and a bottom view thereof, respectively.

As in this example, it is preferable that the paired terminal supports 70 be abutted on flat undersurfaces 77*b* thereof. The surfaces are made flat to enable abutment in a more stable state. However, if stable abutment can be performed, the surfaces are not necessarily made flat. Moreover, even if the surfaces are made flat, the surfaces are simply required to be substantially flat to a degree that allows stable abutment. The abutment is preferably performed in such a manner as to bring both of them into direct contact with each other as in this example. The direct contact allows the facilitation of the manufacture of the electrical connector. However, direct contact is not necessarily required. A member may be sandwiched between them.

When the pair of terminal supports 70 is abutted against each other, the terminals 11 supported by the terminal supports 70 can form a gap "G" (refer to FIGS. 5 and 7) into which a contacted object, for example, the mating protrusion provided in the mating hole 97 of the board connector 90 (refer to FIG. 1), is inserted, between contacts 11*d* of the terminals 11. The gap "G" is formed in the direction "γ" along abutment directions "γ1" and "γ2" of the paired terminal supports 70.

A displacement prevention means may be provided to prevent the terminal supports 70 from being displaced after the abutment. For example, a through-hole 73*a* and a protruding portion 73*b* may be provided to each terminal support 70, and the pair of terminal supports 70 may be fitted at two points to each other in such a manner as to fit the protruding portion 73*b* of one terminal support into the through-hole 73*a* of the other terminal support. Naturally, displacement may be prevented not limited to by the through-hole 73*a* and the protruding portion 73*b* but in other methods.

The vertically arranged portions 75 are vertically arranged on the top surfaces "77*a*" being surfaces on sides opposite to abutment-side surfaces of the paired terminal supports 70, in other words, the undersurfaces 77*b* in the direction "γ" along the abutment directions "γ1" and "γ2", in the directions "γ2" and "γ1" opposite to the abutment directions "γ1" and "γ2". The terminal 11 is fixed by the vertically arranged portion 75 to the terminal support 70 near a base 11*c* formed in a substantially "S" shape. A locking protruding portion 75*a* that is locked to a corresponding locking portion (61*a*) provided to the cable holder 60 is provided on one of the left and right side surfaces of the vertically arranged portion 75.

The cable insulation-displacement portion 11*b* extends in the same direction as the vertically arranged portion 75, on the top surface 77*a* of the main body 77 of the terminal support 70. The cable insulation-displacement portions 11*b* of the plurality of terminals 11 are alternately placed along the direction α. A distal end portion 14 of the cable insulation-displacement portion 11*b* is bifurcated to form a groove. It is configured in such a manner that the twist pair cable 5 held by the cable holder 60 is pressed-fitted in the groove. An outer sheath 5*b* of the twist pair cable 5 press-fitted in the groove (refer to FIG. 5) is cut here. As a result, an internal core 5*a* (refer to FIG. 5) is caught in the groove to bring the cable 5 and the terminal 11 into conduction.

Each of the cable insulation-displacement portions 11*b* is coupled to the wiring portion 11*e*. Pitch changing portions 15 may be provided to part or all of a plurality of the wiring portions 11*e* (in this example, three of four terminals) to change the interval between the wiring portions 11*e* in a pitch direction "β" being an arrangement direction of the terminals 11 (refer to FIG. 8). These pitch changing portions 15 are provided; accordingly, the distance between the cable insulation-displacement portions 11*b* in the pitch direction "β" can be increased as compared to the distance between the distal ends 11*f*, and the pressure connection work can be facilitated.

It is preferable to provide an extending portion 74 extending from the vertically arranged portion 75, on the terminal support 70, to prevent, for example, a part of the core 5*a* exposed from the distal end (terminal) of the cable 5 held by the cable holder 60 from being shortened to an adjacent terminal. The extending portion 74 extends from the vertically arranged portion 75 toward the cable insulation-displacement portion 11*b* side within the top surface 77*a* of the terminal support 70, and covers at least part of the wiring portion 11*e* of the terminal 11 between the vertically arranged portion 75 and the cable insulation-displacement portion 11*b* in the direction "α" along a lead-out direction "α2" of the cable 5 from the cable holder 60. As well illustrated in FIG. 5, the extending portion 74 is preferable to extend to the cable insulation-displacement portion 11*b* side with respect to a front surface 67*e* of the cable holder 60. A taper 74*a* for preventing a collision with the cable holder 60 is formed at a distal end of the extending portion 74.

Figure 10:
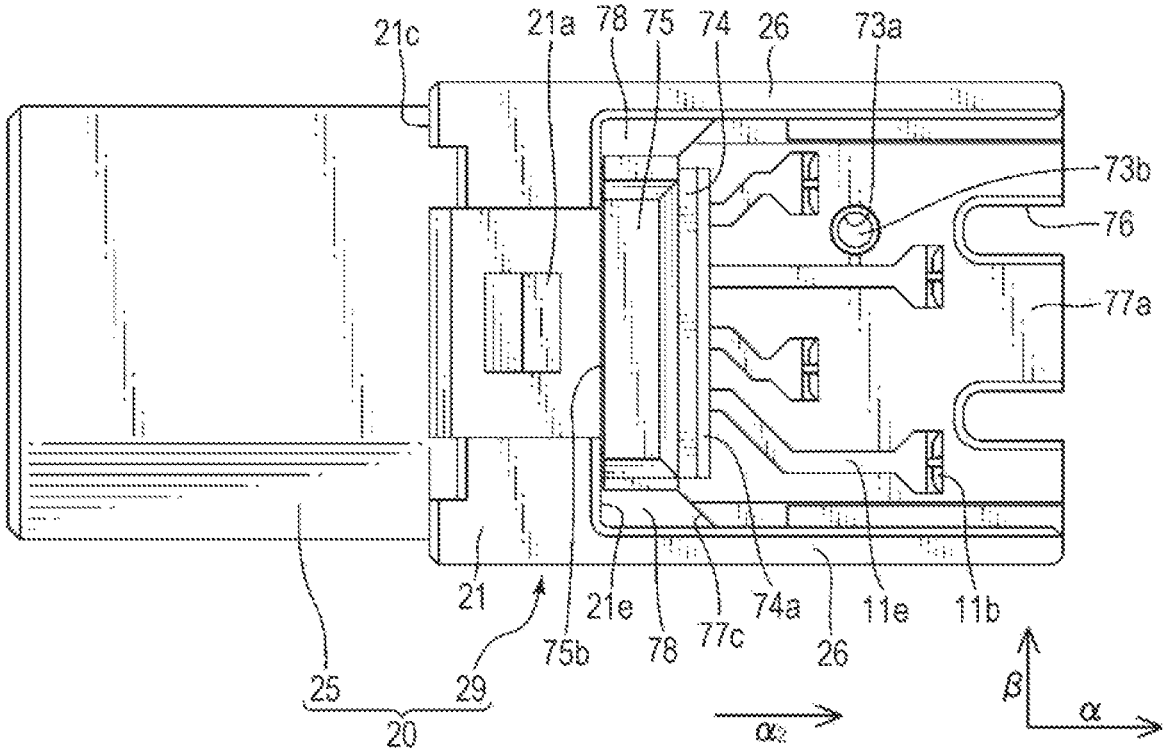
FIG. 10 is a plan view illustrating a state where the terminal supports have been mounted on the housing.
Figure 11:
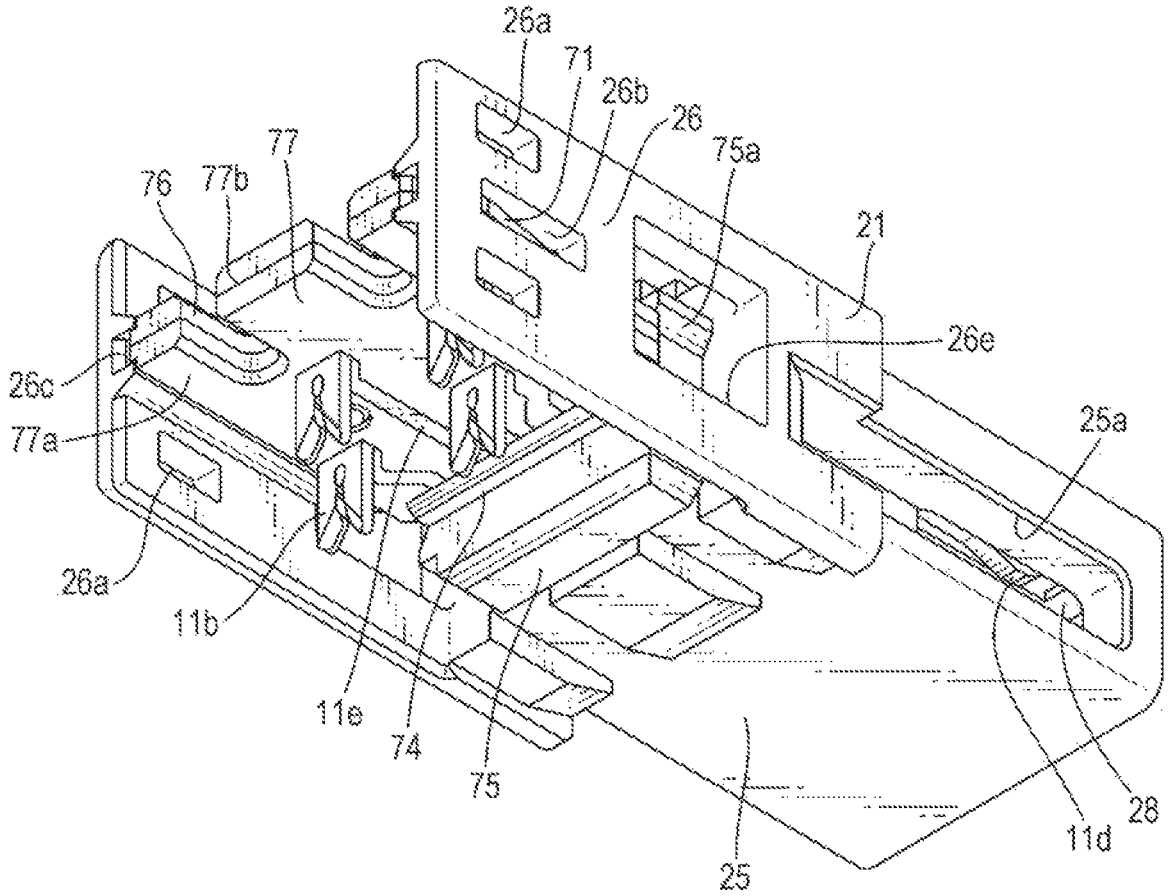
FIG. 11 is a perspective view illustrating the state where the terminal supports have been mounted on the housing.

A method for mounting the terminal supports 70 on the housing 20 is described with reference also to FIGS. 10 and 11. FIG. 10 is a plan view illustrating a state where the terminal supports 70 have been mounted on the housing 20. FIG. 11 is a perspective view of them when viewed from the bottom.

The pair of terminal supports 70 abutting each other are mounted on the housing 20 as they are, for example, parallel to the flat abutting surfaces that abut each other. The terminal supports 70 are guided into the housing 20 in a stable state by sliding left and right side surfaces 71 of the terminal supports 70 along guide grooves 26*c* provided on inner walls of the plate-shaped side walls 26. At this point in time, the pluralities of the terminals 11 supported by the terminal supports 70 are inserted into the inserted portion 25 through terminal insertion holes 21*b* (refer to FIG. 4) provided on an inner wall 21*e* of the base 21. At the time of completing the mounting, a press-fitted portion 11*a* of the terminal 11 is press-fitted in the vicinity of an entrance of the terminal insertion hole 21*b*. Moreover, a font outer wall 75*b* of the vertically arranged portion 75 of the terminal support 70 comes face to face with the inner wall 21*e* of the base 21. A positioning projection 72 provided to the terminal support 70 is fitted into a positioning hole 27 of the base 22. Furthermore, the lock projection 71*a* provided on the side surfaces 71 of the terminal support 70 are fitted into lock holes 26*b* provided on the plate-shaped side walls 26 of the housing 20 to lock the terminal support 70 to the housing 20. The mounted state of the terminal supports 70 can also be checked through windows 26*e* provided on the plate-shaped side walls 26. In this manner, the flat surfaces are abutted against each other to perform mounting on the housing parallel to the flat surfaces; accordingly, the assembly can be made more suitable for mechanical production.

According to this configuration, in this manner, the paired terminal supports 70 that support the terminals 11 are simply abutted against each other, and mounted on the housing 20 as they are. Accordingly, the appropriate gap "G" can be formed between the contacts of the terminals 11. Therefore, it is possible to facilitate the manufacture of the electrical connector 10 and reduce the manufacturing cost. Especially when the abutting surfaces are made flat and the mounting is performed on the housing 20 parallel to the flat surfaces, the assembly can be made more suitable for mechanical production.

Figure 12:
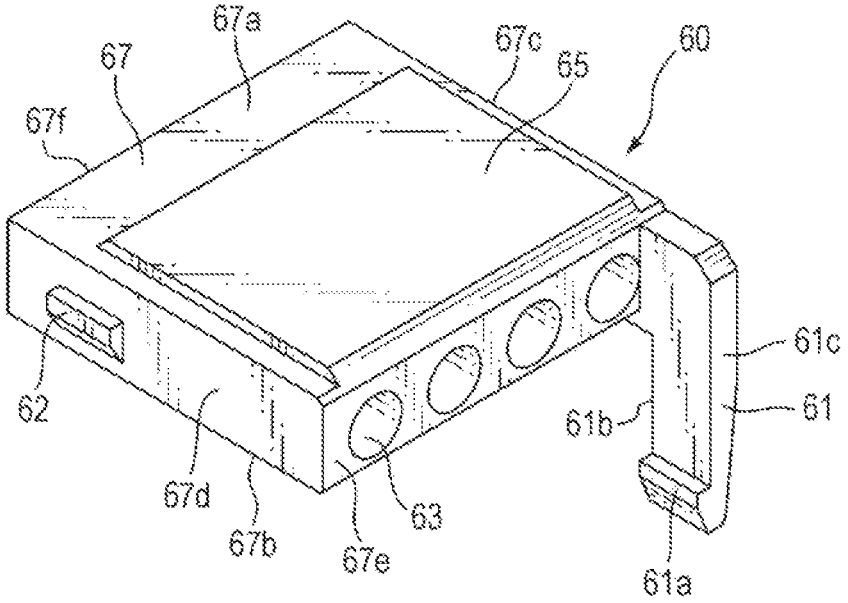
FIG. 12 is a perspective view of a cable holder when viewed from above.
Figure 13:
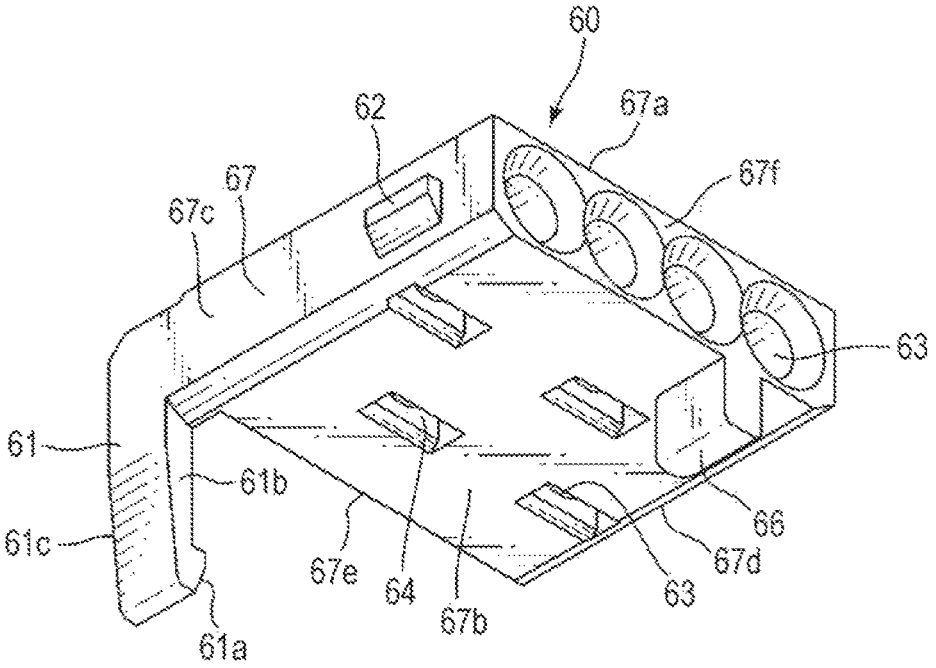
FIG. 13 is a perspective view of the cable holder when viewed from the bottom.

The configuration of the cable holder 60 is described with reference also to FIGS. 12 and 13. FIG. 12 is a perspective view of the cable holder 60 when viewed from above. FIG. 13 is a perspective view when viewed from the bottom. However, in FIGS. 12 and 13, the twist pair cables 5 illustrated in, for example, FIG. 4 are omitted.

The cable holder 60 mainly includes a substantially cuboid main body 67, and a cantilevered arm portion 61 extending from the main body 67 in the mounting directions "γ1" and "γ2" of the cable holders 60 on the housing 20. The arm portion 61 is coupled to the front surface 67*e* and one side surface 67*c* of the main body 67 on one end side opposite to the free end, and is provided in a state of being flush with the one side surface 67*c* of the main body 67 and in a state of protruding frontward of the front surface 67*e* of the main body 67. The arm portion 61 is preferable to be provided in such a manner as to be elastically displaced in a thickness direction. A plurality of through-holes 63 through which the twist pair cables 5 are inserted is provided in the front-and-rear direction (the direction "α") in the main body 67. These through-holes 63 are used to mount one end side of the twist pair cables 5 on the cable holder 60. The mounted one end side of the twist pair cable goes from a rear surface 67*f* to the vicinity of the front surface 67*e* of the main body 67 (refer to, for example, FIG. 5). The inner diameter of the through-hole 63 can be set to be substantially the same as or slightly smaller than the outer diameter of the cable 5. Consequently, an outer peripheral surface of the cable 5 is caught on an inner peripheral surface of the through-hole 63, which can prevent the cable 5 from accidentally coming out of the through-hole 63.

A locking protruding portion 62 that is locked in a locking hole 26*a* (refer to, for example, FIG. 11) provided on the plate-shaped side wall 26 of the housing 20 is provided on each of left and right side surfaces 67*c* and 67*d* of the main body 67. Moreover, the locking protruding portion 61*a* that is locked to the locking protruding portion 75*a* (refer to, for example, FIG. 11) provided on the vertically arranged portion 75 of the terminal support 70 is provided near the free end of the arm portion 61. The locking protruding portions 62 of the cable holder 60 and the locking holes 26*a* on the housing 20 side, and the locking protruding portion 61*a* of the cable holder 60 and the locking protruding portion 75*a* of the terminal support 70 are provided along the mounting directions "γ1" and "γ2" of the cable holders 60 on the housing 20. The cable holder 60 can be locked to the housing 20, using these locking means. In this manner, in the embodiment, the locking of the locking protruding portion 62 of the cable holder 60 and the locking hole 26*a* on the housing 20 side, and the locking of the locking protruding portion 61*a* of the cable holder 60 and the locking protruding portion 75*a* of the terminal support 70 allow the cable holder 60 to be locked at different points respectively to the housing 20 and the terminal support 70. The fixing of these three members (the housing 20, the terminal support 70, and the cable holder 60) can be strengthened. A plurality of locking means is not necessarily provided (in the embodiment, at two points). However, a plurality of them is provided to more reliably fix the cable holders 60 and the housing 20. Moreover, if a plurality of them is provided, the locking protruding portion 62 and the locking protruding portion 61*a*, and their corresponding locking hole 26*a* and locking protruding portion 75*a* are preferably spaced apart from each other in the direction "α" along the lead-out direction "α2" of the twist pair cable 5. They are spaced apart, and are locked at different positions in the lead-out direction of the cable; accordingly, the cable holder 60 can be fixed to the housing 20 in a more stable state.

An insertion hole 64 into which the cable insulation-displacement portion 11*b* of the terminal support 70 is inserted is provided on an undersurface 67*b* of the main body 67. The insertion hole 64 communicates with the through-hole 63 through which the twist pair cable 5 is inserted, and is configured in such a manner as to be capable of cutting the sheath 5*b* (refer to FIG. 5) of the twist pair cable 5 inserted through the through-hole 63, with the cable insulation-displacement portion 11*b* inserted through the through-hole 64, when the cable holder 60 is mounted on the housing 20.

Moreover, a protruding portion 66 that is fitted in the notch 76 provided on the terminal support 70 is provided on the undersurface 67*b* of the main body 67. The protruding portion 66 is vertically arranged on a surface on the mounting side of the cable holder 60 on the housing 20, that is, the undersurface 67*b*, in the mounting directions "γ1" and "γ2" of the cable holders 60 on the housing 20, that is, in the same direction as the arm portion 61.

A method for mounting the cable holders 60 on the housing 20 is described with reference also to FIGS. 14 to 19.

Figure 14:
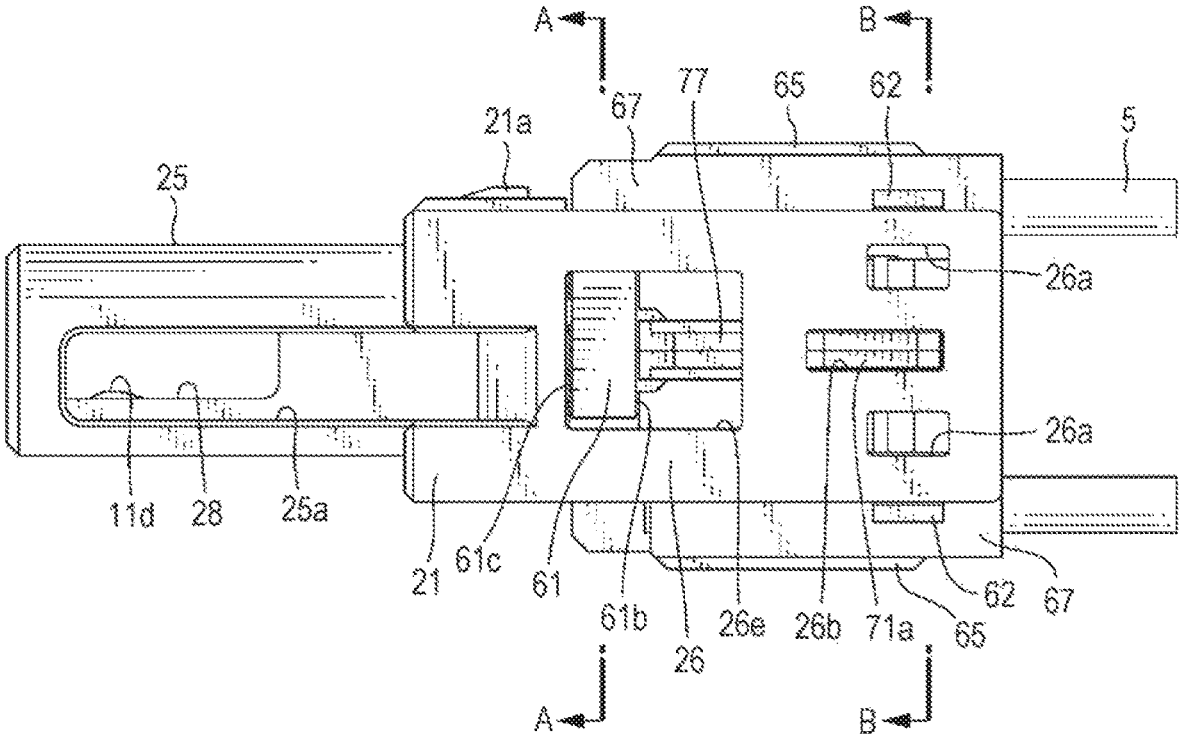
FIG. 14 is a side view of the housing at temporary fixing positions.
Figure 15:
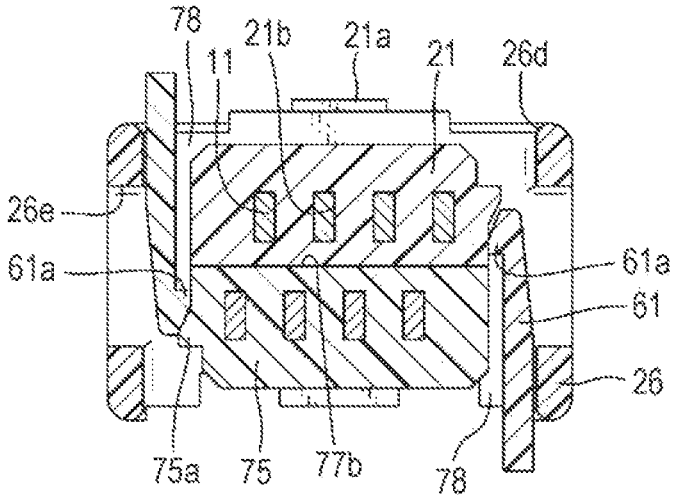
FIG. 15 is a cross-sectional view taken along line A-A in FIG. 14.
Figure 16:
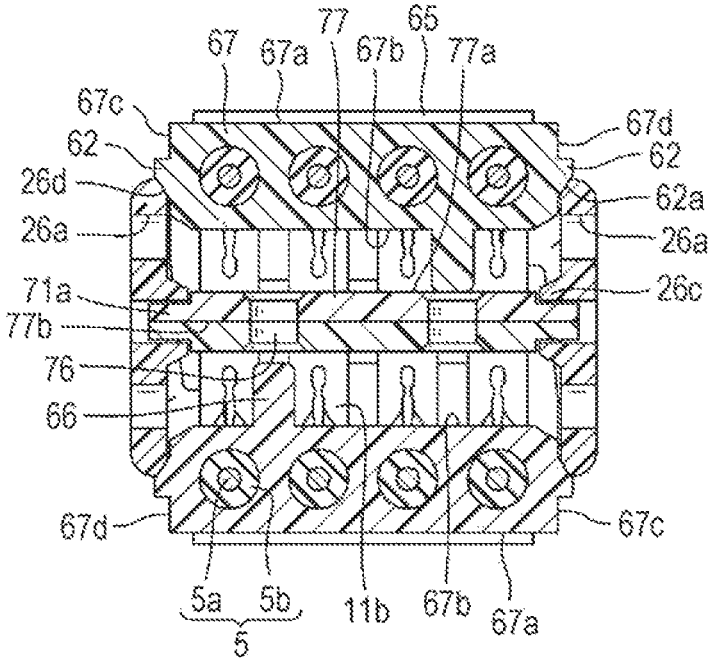
FIG. 16 is a cross-sectional view taken along line B-B in FIG. 14.

FIGS. 14 to 16 illustrate temporary fixing positions, in other words, a state where the locking protruding portions 61*a* and 62 of the cable holder 60 and the corresponding locking portions 75*a* and 26*a* on the housing 20 side are not yet locked. FIG. 14 is a side view of the housing 20 at the temporary fixing positions. FIG. 15 is a cross-sectional view taken along line A-A in FIG. 14. FIG. 16 is a cross-sectional view taken along line B-B in FIG. 14.

Figure 17:
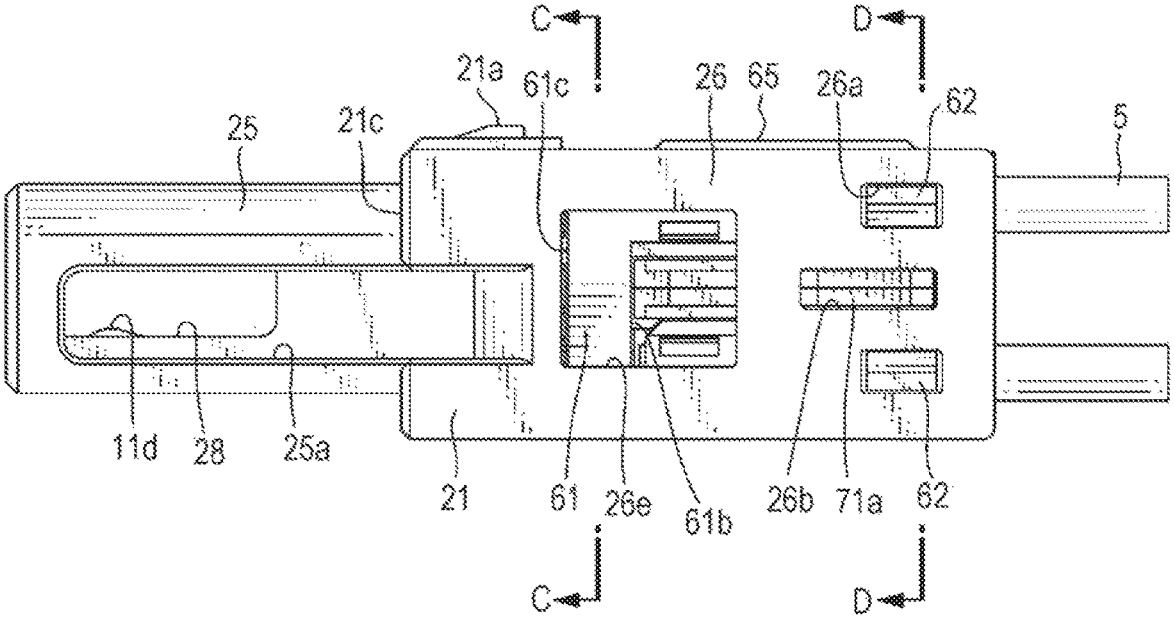
FIG. 17 is a side view of the housing at locking completion positions.
Figure 18:
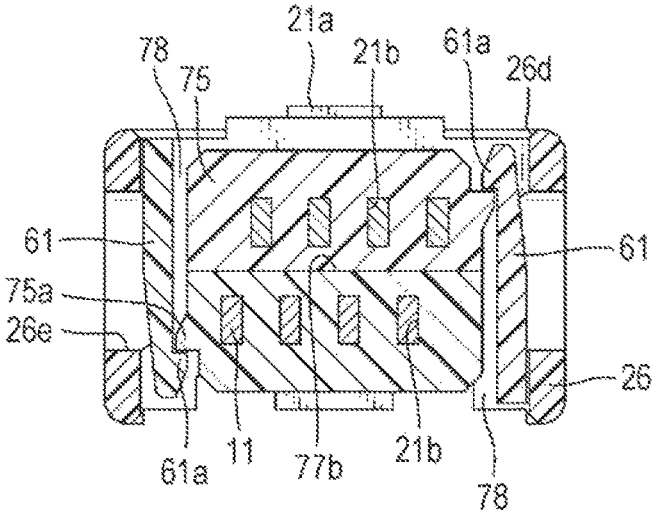
FIG. 18 is a cross-sectional view taken along line C-C in FIG. 17.
Figure 19:
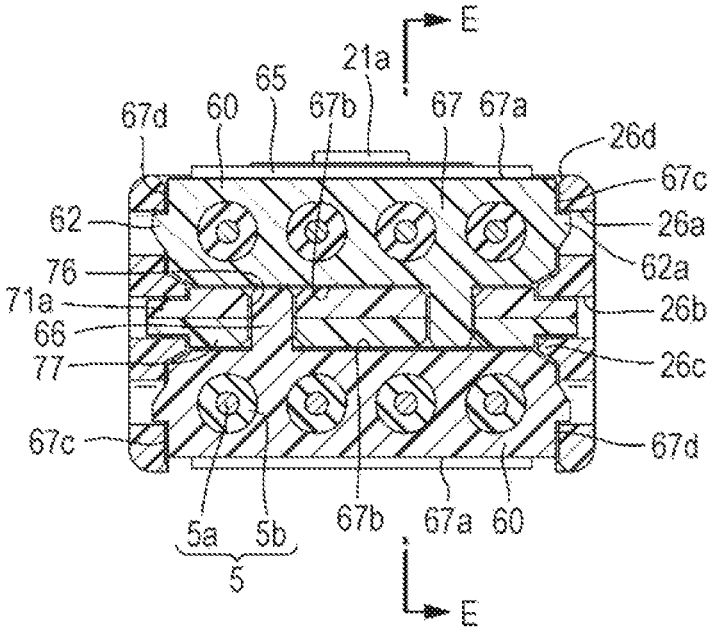
FIG. 19 is a cross-sectional view taken along line D-D in FIG. 17.

On the other hand, FIGS. 17 to 19 illustrate locking completion positions, in other words, a state where the locking protruding portions 61*a* and 62 of the cable holder 60 and the corresponding locking portions 75*a* and 26*a* on the housing 20 side have already been locked. FIG. 17 is a side view of the housing 20 at the locking completion positions. FIG. 18 is a cross-sectional view taken along line C-C in FIG. 17. FIG. 19 is a cross-sectional view taken along line D-D in FIG. 17.

The mounting of the cable holders 60 on the housing 20 and the terminal supports 70 is performed after the terminal supports 70 are mounted on the housing 20, in other words, is performed on the housing 20 in the state of FIGS. 10 and 11. The cable holders 60 are mounted in the abutment directions "γ1" and "γ2" on the top surfaces 77*a* of the terminal supports 70 mounted on the housing 20. In this manner, the abutment directions of the paired terminal supports 70 are made the same as the mounting directions of the cable holders 60 on the terminal supports 70, which makes it suitable for mechanical production to enable a reduction in manufacturing cost.

When the cable holders 60 are mounted on the terminal supports 70 and the housing 20, the cable holders 60 are positioned at the temporary fixing positions illustrated in FIGS. 14 to 16 before being actually locked and fixed. The locking protruding portion 61*a* and the taper 62*a* of the locking protruding portion 62, which are provided to the cable holder 60, collide respectively with the locking protruding portion 75*a* provided on the vertically arranged portion 75 of the terminal support 70 and an upper edge 26*d* of the plate-shaped side wall 26, which are part of the housing 20 side. As a result, the cable holders 60 are positioned in the mounting directions "γ1" and "γ2" in a state of being more apart from the housing 20 than at the locking completion positions. In this manner, the positions are determined to be the temporary fixing positions before locking is actually performed; accordingly, the cable holders 60 can be reliably mounted at predetermined positions of the housing 20 in a more stable state.

In addition, when the cable holders 60 are mounted on the terminal supports 70 and the housing 20, the arm portions 61 of the cable holders 60 are inserted into holes 78 (refer to FIG. 10) formed on the housing 20 side. The hole 78 is formed by the base 21, the plate-shaped side wall 26, and the terminal support 70, which configure the housing 20. When the arm portion 61 is inserted into the hole 78, at least part of the arm portion 61, for example, side surfaces 61*b* and 61*c* in the front-and-rear direction can come face to face with a taper 77*c* formed on the side surface 71 of the terminal support 70, and the inner wall 21*e* of the base 21, which are part of the housing 20, in the direction "α" along the lead-out direction "α2" of the cable 4 from the cable holder 60. As a result, when the cable holders 60 are mounted on the housing 20, it is possible to regulate the movement of the cable holders 60 with respect to the housing 20 in the "α" direction and easily position the cable holders 60 at the predetermined positions of the housing 20. Moreover, it is also possible to easily guide the cable holders 60 to the predetermined positions of the housing 20, using the arm portions 61. Furthermore, also if an undesirable force occurs on the cable holder 60 after the cable holder 60 is mounted on the housing 20, the arm portion 61 faces part of the housing 20 in the direction "α" along the lead-out direction of the cable 4; accordingly, the cable holder 60 can be maintained at the predetermined position of the housing 20.

After being positioned at the temporary fixing positions illustrated in FIGS. 14 to 16, the cable holders 60 can be mounted together on, for example, the housing 20 by, for example, temporarily applying the force to simultaneously sandwich top surfaces 67*a* of the pair of opposing cable holders 60 with fingertips, a jig, or the like. It is preferable to provide a step portion 65 protruding upward on the top surface 67*a* of the cable holder 60 in such a manner as to more reliably allow a fingertip or the like to touch the top surface 67*a* of the cable holder 60. The electrical connector targeted in this case may have the top surface 67*a* with an area of, at most, approximately one square cm. In a case of such a small one, providing the step portion 65 is especially effective.

As illustrated in FIGS. 17 to 19, at the locking completion position, the locking protruding portion 61*a* provided to the arm portion 61 of the cable holder 60 moves over and is locked to the locking protruding portion 75*a* provided to the vertically arranged portion 75 of the terminal support 70. Moreover, the locking protruding portions 62 provided on the side surfaces 67*c* and 67*d* of the main body 67 of the cable holder 60 move over the upper edges 26*d* of the plate-shaped side walls 26 of the housing 20, and are fitted in the locking holes 26*a*. Moreover, at this point in time, the protruding portion 66 provided on the cable holder 60 is placed through the notch 76 provided to the terminal support 70 in a state of being in close proximity to the counterpart cable holder.

When the cable holders 60 shift from the temporary fixing positions illustrated in FIGS. 14 to 16 to the locking completions position illustrated in FIGS. 17 and 19, the twist pair cables 5 held by the cable holders 60 can be connected to the cable insulation-displacement portions 11*b* of the terminals 11, using the force that has been applied to mount the cable holders 60 on the housing 20.

When an excessive force is applied to the cable holders 60 at the time of the shift, the cable holders 60 may be brought close to each other more than necessary and the connector 10 may be broken. However, if such a force is applied, the protruding portion 66 provided on the cable holder 60 collides first with the counterpart cable holder 60 before the cable holder 60 is pressed against the terminal holder 70. Accordingly, damage to the cable holder 60 can be reduced. Especially the protruding portion 66 is located on the lead-out (the arrow "α2") side of the cable 5 to which an excessive force tends to be applied, and further is located at two points in the arrangement direction (the arrow "β") of the cable 5; therefore, it is highly effective.

The present invention is not limited to the above-mentioned embodiment, and other various modifications can be made thereto. The drawings and description of the present application are mere exemplifications, and are not limited to them.

DESCRIPTION OF REFERENCE SIGNS

1 Electrical connector device
4 Electrical cable
5 Twist pair cable
10 Cable connector
11 Terminal
20 Insulating housing
21 Base
28 Mating recess
30 Conductive shell
31 Main body shell
40 Plate-shaped shell
50 Tubular shell
60 Cable holder
61 Arm
61*a* Locking protruding portion
61*b* Rear surface
61*c* Front surface
62 Locking protruding portion
70 Terminal support
74 Extending portion
75 Vertically arranged portion (fixing portion)
78 Hole
90 Board connector

The invention claimed is:

1. An electrical connector comprising:

a housing; and paired terminal supports comprising a first terminal support and a second terminal support, wherein each of the paired terminal supports is capable of supporting terminals in cantilever fashion, and upon being mounted on the housing in a state of abutting each other, the paired terminal supports are capable of forming a gap where a contacted object is inserted, between contacts of the terminals supported by the terminal supports in a direction along abutment directions of the paired terminal supports, wherein each of the first and second terminal supports has a hole and a protrusion, the protrusion of the first terminal support being inserted in the hole of the second terminal support, and the protrusion of the second terminal support being inserted in the hole of the first terminal support, each of the first and second terminal supports has a lock projection on side surfaces of the first and second terminal supports, the lock projection projecting perpendicularly to the abutment directions of the first and second terminal supports and perpendicularly to the side surfaces of the first and second terminal supports, and the housing has a lock hole on a side wall of the housing, the lock projections of the first and second terminal supports being inserted in the lock hole to lock the paired terminal supports to the housing.

2. The electrical connector according to claim 1, wherein in a state where substantially flat surfaces of the paired terminal supports abut each other, the terminal supports are mounted on the housing parallel to the substantially flat surfaces.

3. The electrical connector according to claim 2, wherein the each of the first and second terminal supports has the hole and the protrusion for preventing displacement in a direction parallel to the substantially flat surfaces.

4. The electrical connector according to claim 1, further comprising cable holders that are capable of mounting one end side of a cable thereon, wherein the cable holders are capable of being mounted on the terminal support along the abutment directions on sides of the paired terminal supports opposite to the abutment sides in the direction along the abutment directions.

5. The electrical connector according to claim 4, wherein the terminals include cable insulation-displacement portions vertically arranged in directions opposite to the abutment directions on the sides of the paired terminal supports opposite to the abutment sides in the direction along the abutment directions.

6. The electrical connector according to claim 5, wherein the terminal supports include fixing portions that fix at least part of the terminal on the sides of the paired terminal supports opposite to the abutment sides in the direction along the abutment directions, and at least other part of the terminal within a surface on the opposite side, the other part being located between the fixing portion and the cable insulation-displacement portion, is covered by an extending portion extending from the vertically arranged portion to the cable insulation-displacement portion side within the surface on the opposite side in a direction along a lead-out direction of the cable from the cable holder.

7. The electrical connector according to claim 1, wherein the paired terminal supports have substantially the same size and shape.

8. The electrical connector according to claim 4, wherein the terminal has a cable insulation-displacement portion at an end of terminal, and the cable holder has an insertion hole, the cable insulation-displacement portion of the end of terminal being inserted in the insertion hole.

* * * * *